US005140770A

United States Patent [19]

Morvan

[11] Patent Number: 5,140,770

[45] Date of Patent: Aug. 25, 1992

[54] DOOR WITH A SLIDING LEAF, IN PARTICULAR FOR A RAILROAD VEHICLE

[75] Inventor: Jean-Jacques Morvan, Montlouis sur Loire, France

[73] Assignee: Faiveley Transport, Saint-Denis, France

[21] Appl. No.: 659,449

[22] Filed: Feb. 22, 1991

[30] Foreign Application Priority Data

Feb. 23, 1990 [FR] France ..... 90 02256

[51] Int. Cl.[5] ..... E05D 15/10

[52] U.S. Cl. ..... 49/215; 48/218; 48/223

[58] Field of Search ..... 49/208, 215, 213, 218, 49/216, 209, 221, 223, 225

[56] References Cited

U.S. PATENT DOCUMENTS

| | | | |
|---|---|---|---|
| 3,994,094 | 11/1976 | Marzocco | 49/218 X |
| 4,000,582 | 1/1977 | Monot | 49/218 |
| 4,495,729 | 1/1985 | Britzke et al. | 49/216 X |
| 4,617,756 | 10/1986 | Dilcher | 49/215 X |

FOREIGN PATENT DOCUMENTS

| | | | |
|---|---|---|---|
| 242738 | 10/1965 | Austria . | |
| 345335 | 9/1978 | Austria . | |
| 374151 | 3/1984 | Austria . | |
| 0196488 | 10/1986 | European Pat. Off. . | |
| 0320591 | 6/1989 | European Pat. Off. . | |
| 1315251 | 12/1962 | France | 49/215 |
| 2621879 | 4/1989 | France . | |

*Primary Examiner*—Philip C. Kannan
*Attorney, Agent, or Firm*—Young & Thompson

[57] ABSTRACT

A leaf (8) can move between an open position and a closed position relative to an opening (3, 4, 6, 7). In the closed position, a front edge (12) of the leaf is engaged in a groove (11) of the front edge (3) of the opening. At the beginning of the opening procedure, a thrustor (24) pivots two arms (18*a*, 18*b*), the ends of which slide in grooves (21*a* and 21*b*) of the leaf, toward the outside of the opening. This disengages the rear edge of the leaf relative to the rear edge (4) of the opening. Then, a thrustor displaces a carriage (39) along a slideway (38), while, by way of a roller (47) following a track (51), an arm (41) articulated to the carriage (39) and to the leaf (8) disengages the front edge (12) in a controlled manner relative to the plane of the opening. The arm (41) drives the leaf (8) toward the rear, while the leaf (8) pivots slightly and slides relative to the axis (19*a*) defined by the ends of the two rear arms (18*a* and 18*b*). The lower rear arm (18*b*) sustains in compression the reaction force of the pivoting of the leaf about the axis of the cylindrical slideway (38). The reaction force to the tilting of the leaf (8) about an axis perpendicular to the plane of the opening is provided by the slideway (38) via the joints of the arm (41).

12 Claims, 5 Drawing Sheets

31
16
29
24a
2
18
4
24
21a
19
26
52
6
38
51
56
58
57
59
8
39
42
1
3
41
43
37

P
10
4
34
16
29
31
II
32
28
33
17
23
27
36
27a
23a
24a
IV
18a
21a
19
24
19a
26
53
51c
51e
38a
52
51f
38
51b
39
51d
51
42
59
III
44
41
49
54
8
11
D
46
47
12
48
51a
9
43
37

DOOR WITH A SLIDING LEAF, IN PARTICULAR FOR A RAILROAD VEHICLE

FIELD OF THE INVENTION

The present invention relates to a door with a sliding leaf, in particular for vehicles and especially for railroad vehicles.

The present invention applies, in particular, to doors where the leaf is to be inserted into the opening to be blocked when said leaf is in the closed position. These doors and their guidance and motorized maneuvering device raise difficult problems in terms of reliability, accuracy, wear resistance, size, weight and cost.

It is desired, in particular, for the guidance and motorized maneuvering device not to exceed, widthwise of the opening, a size which is of the order of magnitude of said width. It is desired, in particular, to avoid the slideways on the outer face of the bodywork of the vehicle. Nevertheless, it is desired that, in the open position, the leaf clears virtually the whole opening.

BACKGROUND OF THE INVENTION

Systems have been proposed in which a support slideway enabling the leaf to slide with respect to the opening is furthermore capable of being moved transversely to the opening via arms in order to ensure the inserting and extracting movement of the leaf with respect to the opening at the end of the closing movement and at the beginning of the opening movement respectively. The slideway must be very robust in order to support the weight of the leaf which is cantilevered toward the rear when it is in the open position. The slideway is therefore heavy, the weight supported by the arms during the insertion and the extraction is therefore great, and the device is heavy and expensive. Moreover, the slideway necessarily has such a limited length that it can be reinserted into the opening when the leaf finishes its closing travel. This limits the travel of the slide-way to such an extent that it is generally necessary to double the slideway, in other words to provide a slideway with two telescopic stages so that the leaf clears the opening sufficiently when it is in the open position. This makes the slideway even heavier and further aggravates the problems mentioned above. Furthermore, whether the slideway is in a single stage or two telescopic stages, the arms ensuring the inserting the extracting movement of the leaf may be parallel plunger systems, or else parallel connecting rods forming a deformable parallelogram with the slideway and with the frame of the opening. In both case, the leaf always remains parallel to itself. Thus, the leaf cannot be given certain particular trajectories which are desirable in practice such as the so-called "oscillating" trajectory.

In order to ensure the so-called "oscillating" trajectory, FR-A-2,621,879 discloses a device comprising means for selectively spacing-apart the leaf from the rear edge of the opening, in other words the edged toward which the leaf is displaced during its opening movement. The selective spacing-apart means are associated with two coaxial drive pinions which mesh with two racks, one of which extends along the upper edge and the other of which extends along the lower edge of the leaf. The selective spacing-apart means are also associated with a roller which supports the weight of the leaf in the vicinity of its upper edge, and with rollers which position the leaf laterally in the vicinity of its upper and lower edges. The leaf carries, in the vicinity of its front edge (relative to the closing direction), in other words its edge remote from the selective spacing-apart means when it is in the closed position, an upper roller and a lower roller which follow tracks integrally connected to the frame of the opening and thus contribute toward the lateral positioning of the leaf. These tracks defined the trajectory of the front edge of the leaf, in particular in the vicinity of the closed position. The trajectory of the rear edge of the leaf in the vicinity of the closed position is defined by the selective spacing-apart means. The leaf can therefore assume oblique positions with respect to the plane of the opening. The leaf is prevented from tilting about axes perpendicular to the plane of the opening as the two pinions are coupled rigidly to each other.

It is, however, costly, relatively complex and of a relatively great size along the whole length of the rear edge of the opening. This device also has the disadvantage of requiring racks on the inner face of the leaf.

OBJECT OF THE INVENTION

The object of the invention is thus to provide a door with a sliding leaf which has a simple, robust, relatively lightweight structure of small bulk, permits a large sliding travel, and leaves a large degree of choice with respect to the respective trajectories of the front and rear edges of the leaf.

SUMMARY OF THE INVENTION

According to the invention, there is provided a door with a sliding leaf, in particular for vehicles, especially railroad vehicles, the leaf having a front edge and a rear edge relative to a movement from an open position into a closed position in which the leaf is inserted into an opening and the front and rear edges of the leaf are respectively adjacent to front and rear edges of the opening, comprising means for selectively spacing apart the leaf and the rear edge of the opening, means for guiding the front edge of the leaf, and drive means for displacing the leaf between the open and closed positions, wherein the means for guiding the front edge of the leaf comprise a carriage mounted so as to slide on a slideway along the opening, an arm articulated to the leaf and to the carriage about two separate, substantially vertical axes, the arm being capable of moving between a position of insertion of the front edge of the leaf, in which position said arm points forward from the carriage, relative to the closing direction, and a position of extraction of the front edge of the leaf, in which position said arm points transversely to the plane of the opening, toward the outside of the latter.

The slideway is thus no longer subject to the inserting and extracting movements, and its length is no longer strictly limited to the width of the opening. The travel of the carriage along the slideway can therefore be relatively great, even if the length over which the carriage bears on the slideway is itself relatively great. The arm has the following two essential functions: it determines the spacing between the front edge of the leaf and the plane of the opening; and it increases the displacement travel of the leaf with respect to the sliding travel of the carriage. Indeed, when the arm pivots with respect to the carriage from its position of insertion of the front edge of the leaf, in which it points forward, toward its position of extraction of the front edge of the leaf, in which it is transverse to the plane of the opening, it displaces the leaf toward the rear, in other words toward the open position, with respect to the carriage. In contradistinction to the arms of the prior art, the arm according to the invention supports a leaf which is relatively light since it is not coupled directly to the slideway. The carriage and the arm, although mechanically simple, can be designed to be sufficiently robust to withstand most of, or even all, the force of gravity of the leaf, and certain tilting moments resulting therefrom. Under these conditions, the means for a selective spacing between the leaf and the rear edge of the opening can be considerably simplified and made considerably lighter. The drive means are preferably means for displacing the carriage along the slideway. This is a relatively simple embodiment which makes it possible to dispense completely with the rack-and-pinion system known from FR-A-2,621,879.

The device according to the invention is particularly compact. However, it permits, as does FR-A-2,621,879, a large degree of choice in the trajectory of the leaf since the inserting and extracting movement of the rear edge of the leaf is defined by the selective spacing-apart means, whereas the inserting and extracting movement of the front edge of the leaf is defined by the arm articulated to the carriage.

Other features and advantages of the invention will become further apparent from the description below of a non-limiting example.

DETAILED DESCRIPTION OF THE INVENTION

Figure 2:
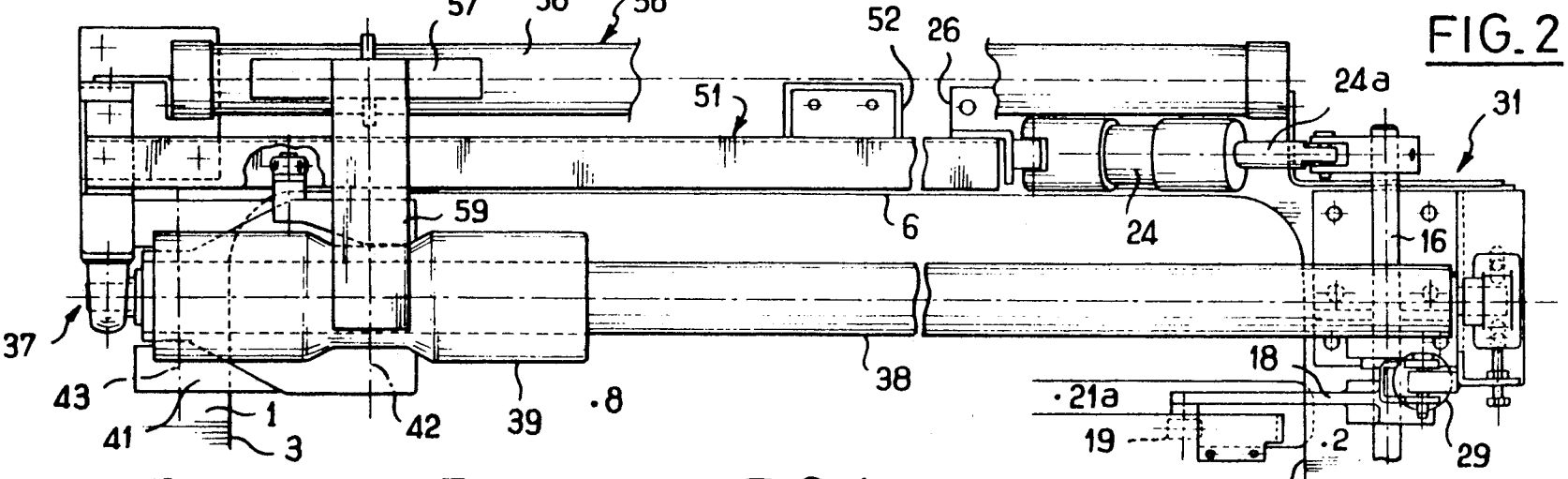
FIG. 2 is a view along the plane II—II of FIG. 1, of the top of the door of FIG. 1.
Figure 1:
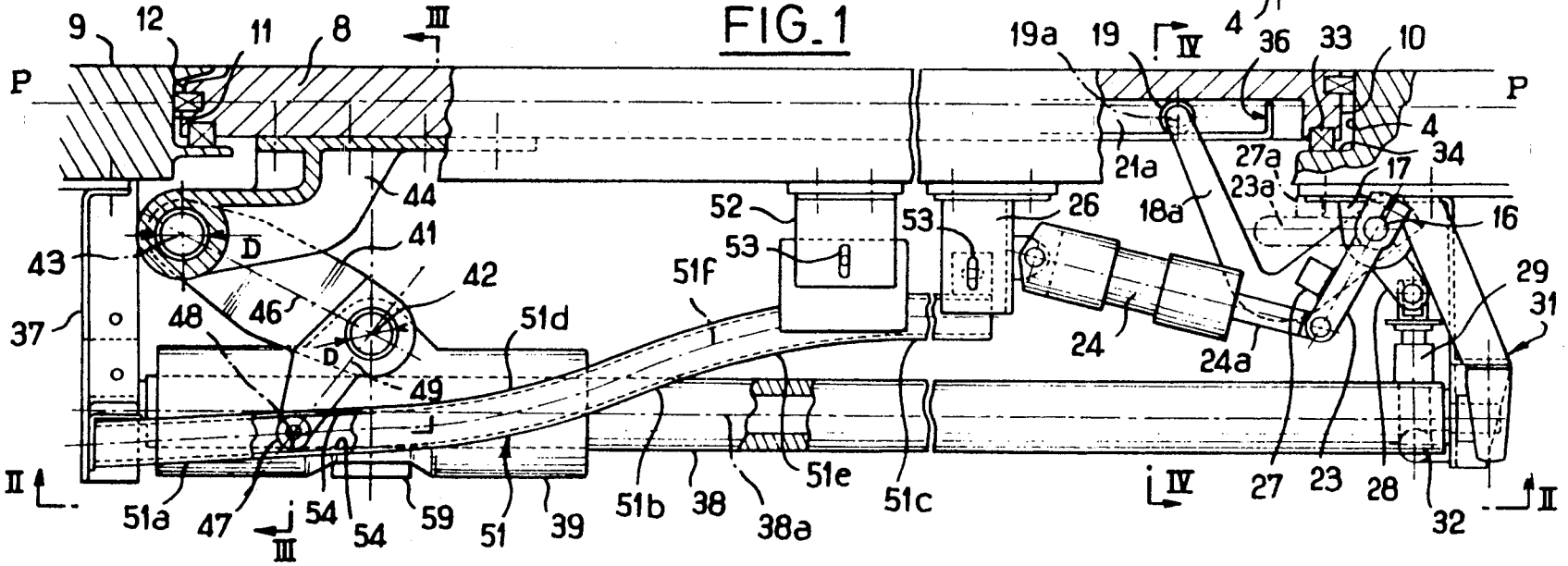
FIG. 1 is a top view, with partial sections and a cutaway, of the door according to the invention, the leaf being in the closed position.
Figure 3:
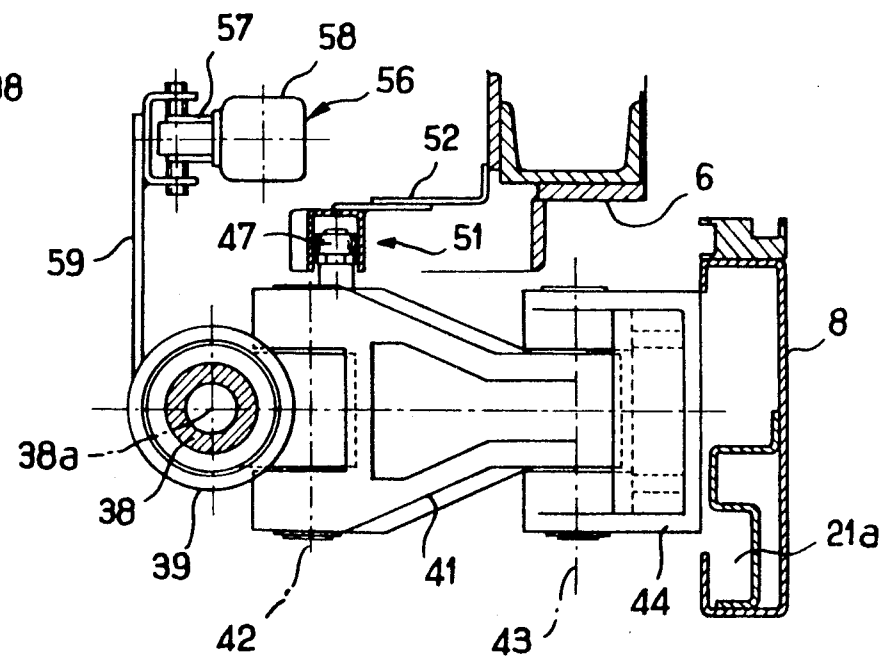
FIGS. 3 and 4 are partial views in section along the lines III—III and IV—IV respectively of FIG. 1, the leaf being in the open position.

In the example shown in the figures, the door according to the invention comprises a frame, two vertical posts 1 and 2 of which can be seen in FIGS. 1 and 2. This frame defines a substantially rectangular opening having a front vertical edge 3 along the post 1, a rear vertical edge 4 along the post 2, and an upper horizontal edge 6 (FIGS. 2 to 4), as well as a lower horizontal edge 7 which is visible in FIG. 5 and the following figures only in dot-and-dash lines. The opening 3, 4, 6, 7 can be closed selectively by a leaf 8 of corresponding shape. In the closed position shown in FIGS. 1, 2 and 5, the leaf 8 is inserted into the opening 3, 4, 6, 7, in other words the outer surface of the leaf 8 is substantially flush with the outer surface 9 of the bodywork of the vehicle.

Furthermore, the front edge 3 of the opening has a groove 11 in which a front edge 12 of the leaf 8 is engaged when the leaf 8 is closed, so as to form between the leaf 8 and the post 1 a mechanical joint capable of resisting the transverse forces which may be exerted on the leaf owing to the variations in pressure which occur, in particular, when passing through tunnels. This tongue-and-groove joint has the advantage of being less costly than a lock system. It will be possible, on the other hand, for the same purpose of mechanical strength, to provide a lock system, not shown, along the rear edge 4.

Figure 5:
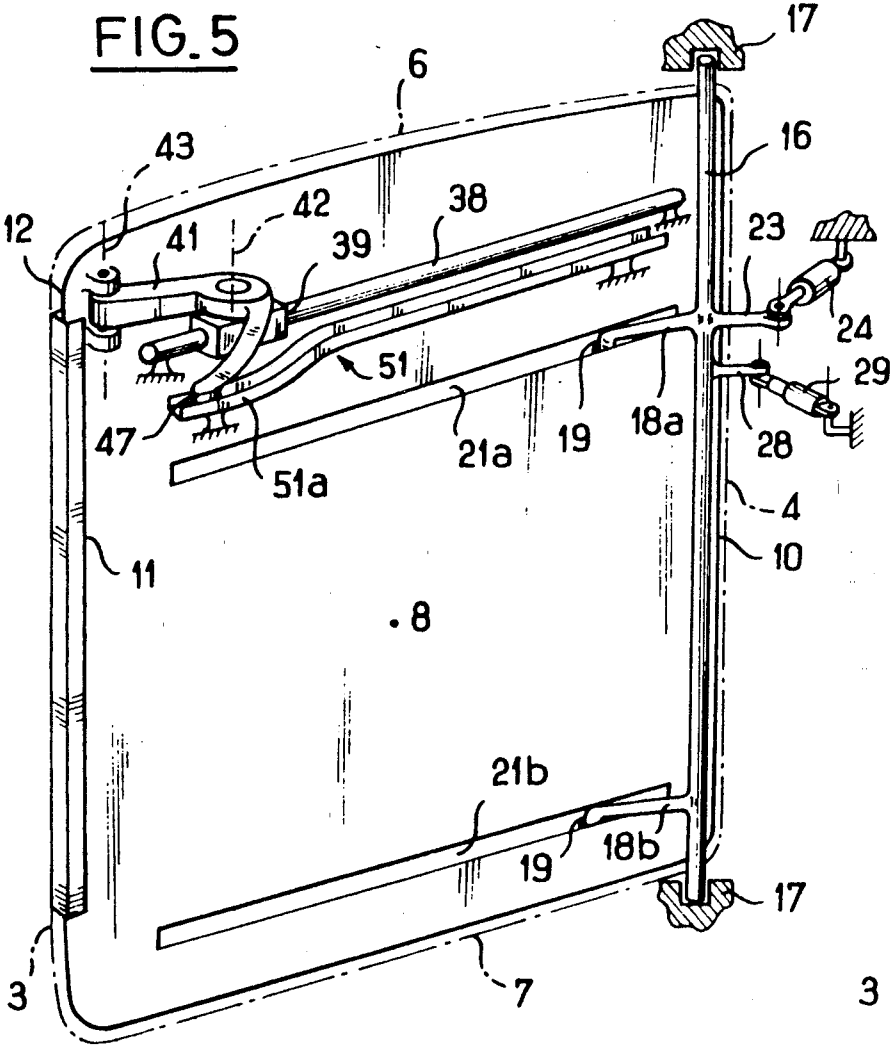
Figure 8:
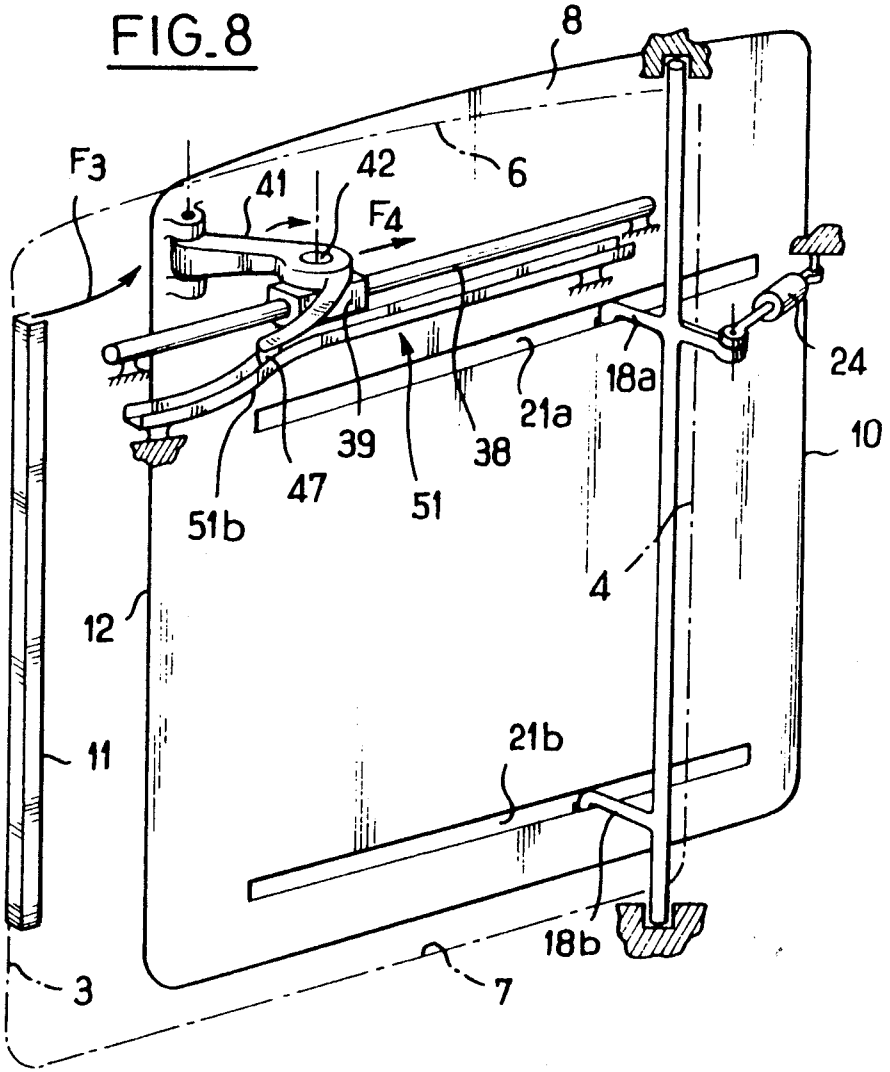
Figure 9:
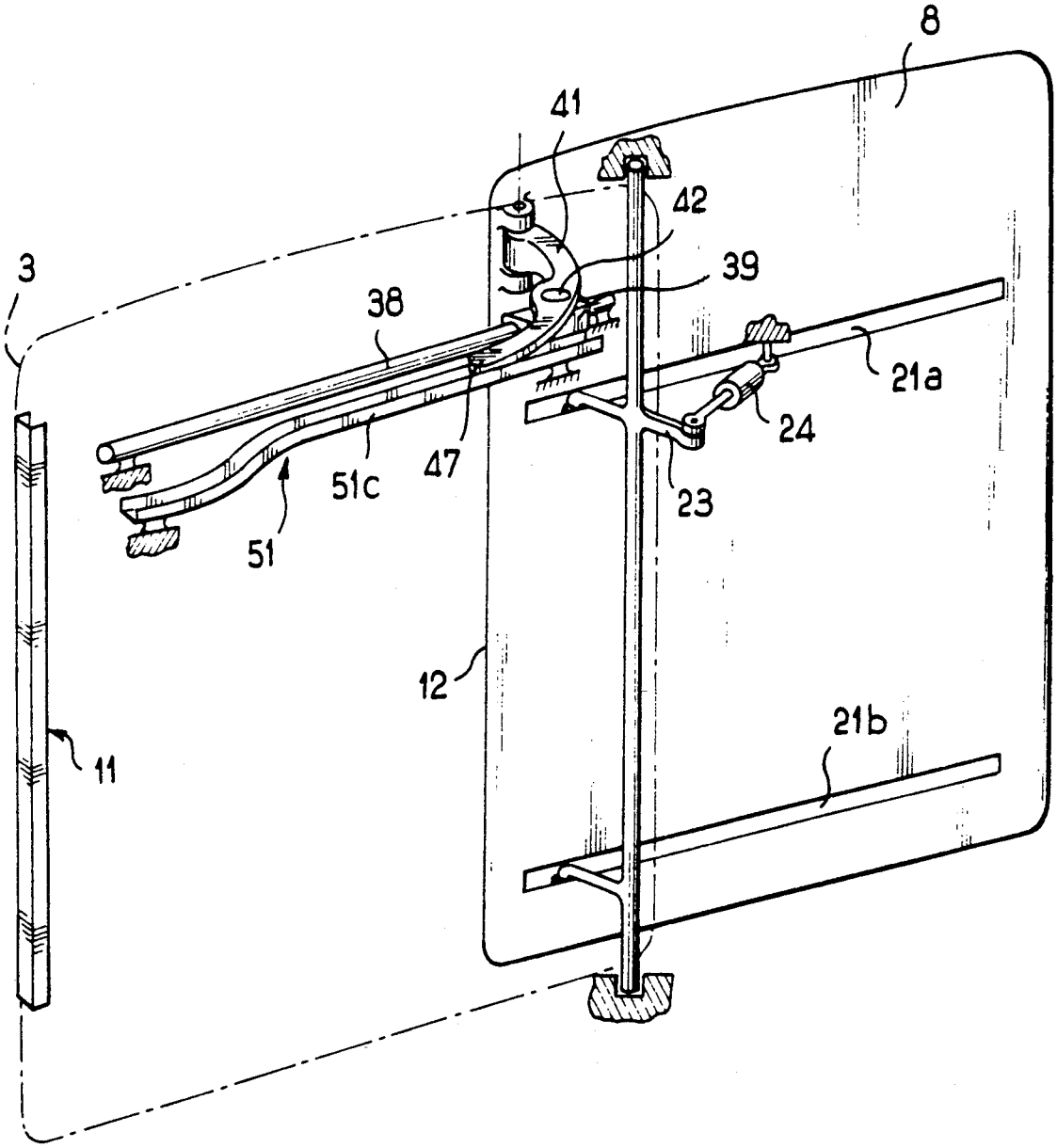

Starting from the closed position of the leaf 8, shown diagrammatically in FIG. 5, in order to move the leaf into the open position, it must first be moved into a disengaged position (arrow F1 in FIG. 6), in which its rear edge 10 is disengaged from the rear edge 4 of the opening, whilst its front edge 12 is still engaged in the groove 11, and the leaf must then be subjected to a rearward movement (arrow F2 in FIG. 7) in order to disengage its front edge 12 from the groove 11, and this rearward movement must then be continued whilst spacing apart the front edge 12 of the leaf toward the outside of the opening (arrow F3 in FIG. 8), in other words toward the outside of the vehicle relative to the plane PP (FIG 1) of the opening, following which the leaf slides substantially parallel to the plane PP as far as the completely open position (FIG. 9).

Figure 6:
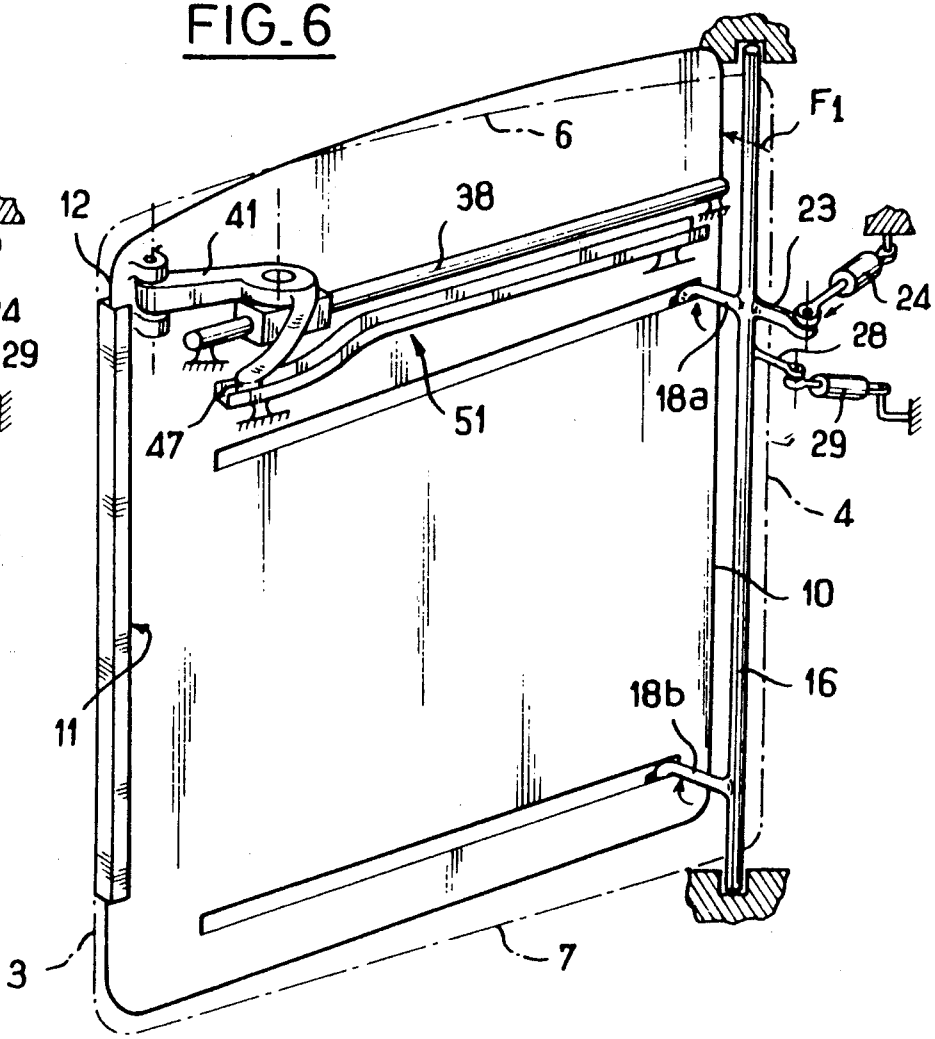
FIGS. 5 to 9 are perspective views of the door according to the invention, from inside the vehicle, at five successive stages of the opening movement of the leaf, in a representation which is simplified and includes, for the purpose of functional clarity, details which have been modified as compared with FIGS. 1 to 4.
Figure 7:
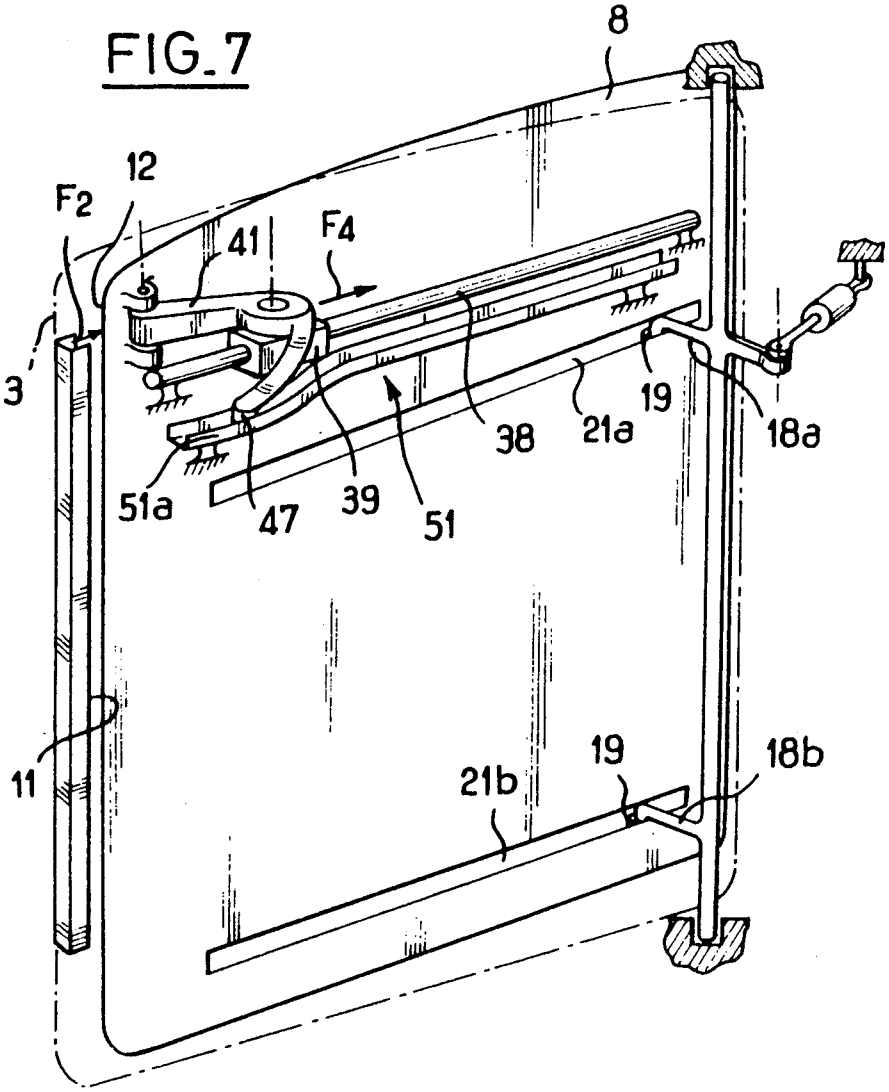

Thus, in the situation shown in FIGS. 6 and 7, and to a lesser degree in that shown in FIG. 8, the leaf is oblique with respect to the plane PP, whereas it is situated in this plane or parallel to this plane in the situations shown in FIGS. 5 and 9.

In order to guide the leaf in this complex trajectory, the door comprises means for selectively spacing apart the rear edge 4 of the opening and the leaf 8.

These means comprise a shaft 16 which is supported in rotation by bearings 17 fixed to the inner face of the bodywork of the vehicle in such a way that the shaft 16 extends along the rear edge 4 of the opening, in otherwords substantially vertical, inside the vehicle relative to the plane PP of the opening, and slightly beyond the edge 4 so as not to obstruct the opening.

Figure 4:
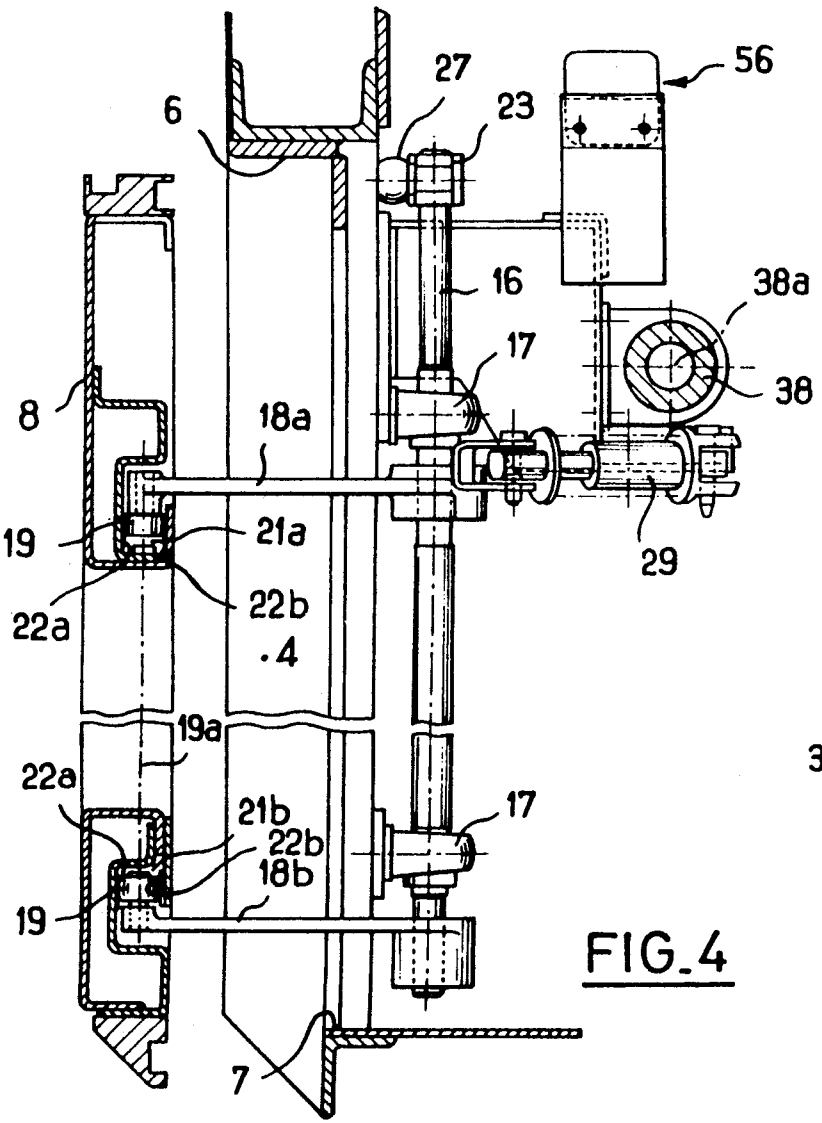

On the shaft 16 are fixed an upper rear arm **18*a* and a lower rear arm 18*b* (see also FIG. 4). The arms 18*a* and 18*b* are angled toward the outside of the vehicle, from the shaft 16, and have, remove from the shaft 16, an end provided with a roller 19 engaged in a guide groove 21*a* and 21*b* respectively, formed in the inner face of the leaf 8. The two rollers 19 have a common axis 19*a*which is parallel to the axis of rotation of the shaft 16 as defined by the bearings 17, and perpendicular to the planes of the trajectories of the various points of the leaf (the plane of FIG. 1 is one of these planes) when the leaf is displaced between its open and closed positions. The two grooves 21*a* and 21*b*** are straight, parallel to each other and parallel to said planes of the trajectories.

The grooves **21*a* and 21*b* respectively are open at the top and at the bottom respectively and each have an outer plane face 22*a* and an inner plane face 22*b* between which runs the roller 19 with a play sufficient to avoid any jamming. Thus, the two rear arms 18*a* and 18*b*, which are in an identical angular position about the shaft 16, position laterally the axis 19*a* relative to which the leaf 8** can have a combined sliding and pivoting movement.

A lever 23 is furthermore fixed to the shaft 16, the free end of the lever being articulated to the outer end of the rod **24*a* of a jack 24 for controlling the pivoting of the shaft 16 about its axis. The body of the jack 24 is articulated to a bracket 26** fixed on the inner face of the bodywork of the vehicle, above the opening.

The lever 23 can move under the action of the jack 24 between the position shown in FIG. 1, when the leaf 8 is in the closed position, and a position **23*a*, shown in dot-and-dash lines in FIG. 1, in which a stop 27 integrally connected to the lever 23 is situated in a position 27***a*, bearing against the inner face of the bodywork of the vehicle. This position 27*a*, which corresponds to the position of extraction of the rear edge 4 of the leaf (FIG. 6), is then maintained during the remainder of the opening movement of the leaf.

The lever 23 and the stop 27 can also be seen in FIG. 4, in the position designated by 23*a* and 27*a* in FIG. 1, the jack 24 not being shown in FIG. 4, for sake of clarity.

Also fixed to the shaft 16 is a bistability lever 28 (FIG. 1), having, remote from the shaft 16, an end articulated to an end of an elastic compression device 29 of the plunger type, the other end of which is itself articulated to a support 31 integrally connected to the bodywork of the vehicle, The line of action 32 of the elastic compression device 29 passes from one side of the axis of the shaft 16 to the other when the lever 23 passes from its position shown in solid lines in FIG. 1 to its position 23*a* shown in dot-and-dash lines in FIG. 1. Consequently, in the position shown in solid lines, the arms 18*a* and 18*b* draw the leaf 8 toward the inside of the vehicle under the action of the elastic compression device 29, without there being any need for the jack 24 to be energized. A bearing contact is thus formed between a facial seal 33 carried by the leaf 8 on its inner face along its rear edge 10, and a step 34 which the bodywork of the vehicle has along the rear edge 4 of the opening, facing toward the outside of the vehicle.

Similarly, when the lever 23 is in the position 23*a*(-FIG. 1), the elastic compression device 29 presses the stop 27 into its position 27*a* against the inner face of the bodywork of the vehicle, and thus stabilizes the arms 18*a* and 18*b* in their position of extraction of the rear edge of the leaf relative to the plane PP of the opening. This is obtained, once again, without any need that the jack 24 be energized. During functioning, the jack 24 therefore needs only be supplied during the short time intervals in which the rear arms 18*a* and 18*b* must change position. The jack 24 is of the double acting type in order to ensure the two directions of movement of the levers 18*a* and 18*b*.

In the vicinity of the rear edge of the leaf 8, the guide grooves 21*a* and 21*b* terminate in a stop 36 which strikes the rollers 19 when, during the closing movement of the leaf 8, the latter approaches the position shown in FIG. 6, from that shown in FIG. 7. This striking produces, on the arms 18*a* and 18*b*, a moment initiating their rotation toward the position shown in solid lines in FIG. 1.

The door according to the invention furthermore comprises, in the vicinity of the front edge 3 of the opening, in the upper region of the latter, a support 37 opposite the support 31 already mentioned. The supports 31 and 37 support, rigidly between them, a slideway 38 consisting of a tube with a cylindrical outer surface, the axis of which is designated by 38*a*.

A carriage 39 in the form of a sleeve is mounted so as to slide on the slideway 38. An arm 41 is articulated to the carriage 39 about an axis 42, and to the leaf 8 at an axis 43. The axes 42 and 43 are parallel to each other and perpendicular to the planes of the trajectories (in particular to the plane of FIG. 1). The axes 42 and 43 are spaced apart from each other, the axis 43 being spaced apart from the plane PP toward the inside of the vehicle and offset longitudinally beyond the front edge 3 of the opening by a bracket 44 fixed to the leaf 8.

When the leaf 8 is in the closed position, the arm 41, and more particularly its plane 46 containing the axes 42 and 43, points forward, relative to the closing direction of the leaf, from the axis 42 toward the axis 43. In the example shown, this orientation toward the front is oblique.

The axial length of the carriage 39 is, for example, 250 mm, the external diameter of the slideway 38 being 50 mm. The slideway 38 thus has an excellent rigidity with respect to bending, and the coaxiality between the carriage 39 and the slideway 38 is excellent even if tilting moments are exerted on the carriage 39 about axes perpendicular to the axis of the slideway 38. The arm 41 and the joints 42 and 43 have a robust construction, the joints having, in particular, a relatively great axial dimension and a relatively great journal diameter of the order of 25 mm. Taking into account all these dimensional features, the leaf 8 is, with a high degree of accuracy, immobilized relative to the slideway 38 against any rotation about an axis perpendicular to the plane PP of the opening. In other words, the link ensured between the slideway 38 and the leaf 8 by the carriage 39 and the arm 41 alone prevents the leaf 8 from pivoting in its own plane. In particular, the rollers 19, and more generally the angled arms 18*a*, 18*b*, are not mounted in order to apply a reaction force counter to such an undesirable rotation.

On the other hand, the carriage 39 is mounted so as to be free to rotate on the slideway 38 about the axis 38*a* of the slideway 38. In the link between the leaf 8 and the slideway 38, the rotation between the carriage 39 and the slideway 38, about the axis 38*a* of the latter is the only rotation possible about an axis parallel to the slideway 38. In other words, the leaf 8 is integrally connected to the carriage 39 in terms of rotation about any axis parallel to the axis 38*a* of the slideway 38. Nevertheless, given the freedom in rotation between the carriage 39 and the slideway 38 about the axis of the slideway 38, another positioning means is necessary to position the leaf 8 about the axis 38*a* of the slideway 38. This positioning means consists of the roller 19 of the angled arm 18*b* against which bears, at a distance beneath the axis 38*a* and in a direction transverse to the plane PP, the outer plane surface 22*a* of the groove 21*b* (FIG. 4). This bearing contact is caused by the weight of the leaf, and more precisely the moment of this weight about the axis 38*a* of the slideway 38, which moment is balanced by the moment, about the same axis, of the reaction of the roller 19 against the plane surface 22*a* of the groove 21*b*.

The arm 41 ensures the guidance of the front edge 12 of the leaf 8 during the opening and closing movements of the latter. To this end, the arm 41 carries, at a distance from the axes 42 and 43, a track-following roller 47, the axis 48 of which is parallel to the axes 42 and 43. The plane 49 containing the axes 42 and 48 is directed forward (relative to the closing direction of the leaf) and toward the inside of the vehicle when the arm 41 is in the position in which the front edge of the leaf 8 is inserted into the opening. The roller 47 is engaged in a track 51 which is fixed, on the one hand, to the support 37 and, on the other hand, to the bracket 26, as well as to various intermediate brackets such as 52 (other brackets similar to 52 are not shown as they are situated in the part of the device which is cut away in (FIG. 1). The fixing of the track 51 to the brackets 26 and 52 is realized by screws passing through elongated holes 53 permitting an accurate setting of the position during mounting.

The track 51 is a U-shaped rail comprising two vertical and opposite inner faces 54 between which the roller 47 is received with a certain sliding play.

The track 51 comprises a front region 51*a* adjacent to the front edge 3 of the opening and extending substantially parallel to the plane PP, an intermediate region 51*b* which is oblique with respect to the plane PP and connects the front region 51*a* to a rear region 51*c* which is parallel to the plane PP and closer to the plane PP than the front region 51*a*. The transition between the front region 51*a* and the intermediate region 51*b* is made by a curve 51*d*, the concavity of which is turned toward the outside of the vehicle. A curve 51*e*, the concavity of which is turned toward the inside of the vehicle, effects the transition between the intermediate region 51*b* and the rear region 51*c*. The axis 51*f* of the slideway 51 is situated in a plane perpendicular to the axes 42, 43 and 47.

Thus, when the carriage 39 is displaced along its slideway 38, the track 51 causes, as a function of the position of the carriage along the slideway, the roller 47 to move with respect to the axis 42 and, consequently, the arm 41 to rotate between the position in which the front edge 12 of the leaf 8 is inserted into the opening, which position is shown in FIG. 1, and a position in which the front edge 12 of the leaf 8 is extracted relative to the opening toward the outside of the vehicle, as is shown in FIG. 9. FIG. 8 shows an intermediate position between the two above-mentioned extreme positions.

The distance between the axes 42 and 47 is approximately equal to half the distance between the axes 42 and 43 of the arm 41, with the result that the movements of the roller 47 with respect to the axis of articulation 42 cause amplified movements of the axis of articulation 43 about the axis of articulation 42. The overall size of the device in the direction transverse to the plane PP is thus reduced.

A drive means consisting of a rodless jack 56 is mounted between the supports 31 and 37 and is immobilized between them. A rodless jack is a known device producing a movement by displacing a slide 57 along a longitudinal slot (not shown) extending over the entire length of a body 58 of the jack. The slide 57 of the rodless jack 56 is coupled rigidly to the carriage 39 by a plate 59.

The operation of the door according to the invention will now be described with reference to FIGS. 5 to 9.

When the leaf is closed, the situation is that shown in FIGS. 1, 2 and 5. The arm 41 is inclined forward in the position of insertion of the front edge of the leaf, the carriage 39 is at the front end of the slideway 38, the plane passing through the axis of the shaft 16 and through the common axis 19*a* of the two rollers 19 is inclined forward, the bistable means 28, 29 apply the seal 33 of the rear edge of the leaf against the step 34 of the rear edge 4 of the opening, and the jack 24 is not energized. Where necessary, a lock completes the action of the bistable device 28, 29 in order to keep the rear edge of the leaf in the plane PP. The front edge of the leaf requires no special device for this purpose since it is engaged in the groove 11 of the front edge 3 of the opening.

In order to open the leaf, after having released any locks, firstly the jack 24 is energized in the direction of contraction in order to cause the arms 18*a* and 18*b* to pivot toward the outside of the vehicle as far as their position of extraction of the rear edge of the leaf, which position is shown in FIG. 6. During this movement, a stiff point must be overcome by the jack 24 when the bistable device 28, 29 is in the state of maximum compression since, in the remainder of the movement, the bistable device aids the jack 24. In the concrete example shown in FIG. 1, the jack 24 is arranged toward the front, relative to the lever 23 which it actuates, and the lever arm length with which the jack 24 acts on the shaft 16 becomes zero when the leaf approaches the position of total extraction of the rear edge. In FIGS. 5 to 9, for reasons of clarity, the jack has been placed on the other side of the arm 23, with the result that the jack 24 must be actuated into extension in order to cause extraction of the rear edge.

Then, as shown in FIG. 7, by an arrow F4, the carriage 39 is moved along the slideway 38 by the drive means (not shown in this figure). Initially, the track-following roller 47 travels over the front region 51*a* of the slideway 51, so that the arm 41 remains substantially stationary with respect to the carriage 39, and the front edge 12 is displaced rearward, substantially in the plane PP, in the direction of the arrow F2, and is thus disengaged from the groove 11 of the front edge 3 of the opening. Furthermore, the leaf 8, and more particularly its slide channels 21*a* and 21*b*, slide relative to the axis 19*a* of the two rollers 19, which axis forms a positioning axis. The arms 18*a* and 18*b* remain stationary. In order to simplify matters, in FIGS. 7 et seq, the bistable device, which will no longer change state with respect to the situation shown in FIG. 6, is not shown.

As shown in FIG. 8, whilst the carriage 39 continues to travel along the slideway 38 in the direction of the arrow F4, the track-following roller 47 travels over the region 51*b* of the slideway 51 with the result that the arm 41 begins to pivot about the axis 42 with respect to the carriage 39, with the result that the front edge 12 of the leaf 8 is extracted toward the outside of the vehicle, relative to the plane PP.

With the carriage 39 continuing to travel still further along the slideway 38 (FIG. 9), the roller 47 travels over the region 51*c* of the slideway 51 with the result that the arm 41 assumes, about its axis 42 relative to the carriage 39, an orientation of maximum extraction of the front edge 12 of the leaf 8. The leaf 8 is then substantially parallel to the plane PP but offset toward the outside of the opening with respect to the latter in order to slide along the outer face of the bodywork, not in contact with the latter.

The reverse operations make it possible to return the leaf into the closed position.

In the closed position (FIG. 5), the leaf experiences a certain centering effect from the periphery of the opening. However, apart from this position, and in particular in all positions other than those close to the position of total closure, the leaf is positioned only by its articulation to the arm 41 and by its sliding articulation to the arms 18*a* and 18*b* about the common axis 19*a* of the rollers 19 carried by these arms 18*a* and 18*b*.

The invention is not, of course, limited to the example described and shown. The means for controlling the orientation of the arm 41 could differ and could, for example, be a jack.

The means for displacing the carriage along the slideway can be a device other than a rodless jack, for example a screw/nut system. It could even be envisaged for the drive means to act directly on the leaf.

The invention can be applied to doors in which the leaf remains at all times substantially parallel to itself.

I claim:

1. A door with a sliding leaf for a vehicle, the leaf (8) having a front edge (12) and a rear edge (10) relative to a movement from an open position into a closed position in which the leaf (8) is inserted into an opening (3, 4, 6, 7) and the front and rear edges of the leaf are respectively adjacent to front (3) and rear (4) edges of the opening, comprising means (16, 18*a*, 18*b*, 19, 23, 24) for selectively spacing apart the left and the rear edge (4) of the opening, drive means (56) for displacing the leaf between the open and closed positions, said door having in the vicinity of its opening means for supporting a slideway(38), and means (41, 47, 51) for guiding the front edge (12) of the leaf, which means for guiding include a carriage (39) mounted so as to slide on a slideway (38), an arm (41) articulated to the leaf (8) and to the carriage (39) about two separate, substantially vertical axes (42, 43), the arm (41) being capable of moving between a position of insertion of the front edge of the leaf, in which position said arm points forward from the carriage (39) relative to the closing direction; and a position of extraction of the front edge of the leaf, in which position it points transversely to the plane (PP) of the opening toward the outside of the latter.

2. The door as claimed in claim 1, in which the means for guiding the front edge of the leaf further include means (47, 51) for actuating the arm between its positions of insertion and extraction of the front edge.

3. The door as claimed in claim 2, in which the means for actuating the arm are responsive to the position of the carriage (39) along the slideway (38).

4. The door as claimed in claim 3, in which the means for actuating the arm comprise a profiled track (51) and a track follower (47) linked to the arm (41) and spaced apart from the axis (42) of articulation of the arm (41) with the carriage (39), and mounted in order to follow the profile of the track (51) when the carriage (39) travels over the slideway (38).

5. The door as claimed in claim 4, in which the track follower (47) is less far apart from the axis (42) of articulation between the carriage (39) and the arm (41) than the axis (43) of articulation between the arm (41) and the leaf (8).

6. The door as claimed in claim 1, in which the drive means (56) are means for displacing the carriage (39) along the slideway (38).

7. The door as claimed in claim 1, in which a link ensured between the slideway (38) and the leaf (8) by the carriage (39) and the arm (41) immobilizes the leaf (8) relative to the slideway (38) against any rotation about an axis perpendicular to the plane (PP) of the opening.

8. The door as claimed in claim 1, in which a link between a frame (2, 3) of the opening and the leaf (8) via the carriage (39), the arm (41) and the slideway (38) comprises a degree of freedom in rotation about a single axis (38*a*) substantially parallel to the slideway (38), the lead (8) being prevented from rotating about this axis by a pressing means (18*b*, 19) applying a reaction force to the leaf in a direction transverse to the plane (PP) of the opening at a distance from said axis (38*a*) substantially parallel to the slideway (38).

9. The door as claimed in claim 8, in which the axis substantially parallel to the slideway is an axis (38*a*) of the slideway (38), the carriage (39) being mounted so as to be freely rotatable with respect to the slideway 938) about the axis (38*a*) of the slideway, 10. The door as claimed in claim 8, in which the pressing means (18*b*, 19) consists of at least one part of the means (16, 18*a*, 18*b*, 19, 23, 24) for selectively spacing apart the leaf (8) and the rear edge (4) of the opening.

11. The door as claimed in claim 1, in which the selective spacing-apart means define an axis (19*a*) adjacent to the rear edge (4) of the opening and relative to which the leaf (8) pivots and slides, and comprise means (18*a*, 18*b*, 16, 23, 24) for selectively displacing this axis (19*a*) between a position of insertion of the rear edge of the leaf, and a position of extraction of the rear edge of the leaf, and bistable means, (28, 29) for stabilizing the axis (19*a*) adjacent to the rear edge in its two abovementioned positions.

12. The door as claimed in claim 11, in which the axis (19*a*) adjacent to the rear edge is carried by at least one rear pivoting arm (18*a*, 18*b*) carrying a finger (19) engaging a guide (21*a*, 21*b*) carried by the leaf (8).

* * * * *